United States Patent [19]

Everett

[11] Patent Number: 4,639,302

[45] Date of Patent: Jan. 27, 1987

[54] ELECTROLYTIC CELL FOR RECOVERY OF METALS FROM METAL BEARING MATERIALS

[75] Inventor: Peter K. Everett, Chatswood, Australia

[73] Assignee: Dextec Metallurgical Pty. Ltd., New South Wales, Australia

[21] Appl. No.: 638,485

[22] PCT Filed: Dec. 9, 1983

[86] PCT No.: PCT/AU83/00182

§ 371 Date: Jul. 26, 1984

§ 102(e) Date: Jul. 26, 1984

[87] PCT Pub. No.: WO84/02356

PCT Pub. Date: Jun. 21, 1984

[30] Foreign Application Priority Data

Dec. 10, 1982 [AU] Australia ..... PF7223

[51] Int. Cl.[4] ..... C25C 7/00; C25C 7/08; C25C 7/02

[52] U.S. Cl. ..... 204/258; 204/261; 204/262; 204/290 R; 156/86

[58] Field of Search ..... 204/263, 265, 269, 272–274, 204/277, 289, 290 R, 257, 258, 117–118, 261, 282–283, 262; 156/85–86

[56] References Cited

U.S. PATENT DOCUMENTS

| | | | |
|---|---|---|---|
| 567,503 | 9/1896 | Pelatan et al. | 204/273 X |
| 668,842 | 2/1901 | Rouse | 204/273 X |
| 893,472 | 7/1908 | Forget | 204/261 |
| 2,997,438 | 8/1961 | James et al. | 204/273 |
| 3,022,242 | 2/1962 | Anderson | 204/290 R X |
| 3,196,101 | 7/1965 | Hosford, Jr. | 204/282 X |
| 3,806,434 | 4/1974 | Goold et al. | 204/273 X |
| 3,821,097 | 6/1974 | Ettel | 204/282 X |
| 3,875,041 | 4/1975 | Harvey et al. | 204/273 |
| 3,959,112 | 5/1976 | Arend, Jr. | 204/277 X |
| 4,061,552 | 12/1977 | Everett | 204/107 |
| 4,096,053 | 6/1978 | Emmett et al. | 204/273 X |
| 4,107,006 | 8/1978 | Winand | 204/105 M |
| 4,263,120 | 4/1981 | Berndt et al. | 204/273 |
| 4,391,695 | 7/1983 | Koziol et al. | 204/286 |
| 4,500,402 | 2/1985 | Miles et al. | 156/86 X |

FOREIGN PATENT DOCUMENTS

| | | |
|---|---|---|
| 377415 | 4/1973 | U.S.S.R. . |
| 478066 | 1/1976 | U.S.S.R. . |
| 461657 | 11/1977 | U.S.S.R. . |

*Primary Examiner*—Donald R. Valentine

*Attorney, Agent, or Firm*—Schwartz, Jeffery, Schwaab, Mack, Blumenthal & Evans

[57] ABSTRACT

An electrolytic cell for recovery of metal from mineral ores or concentrates comprising a tank for holding a slurry of electrolyte and the mineral ore or concentrates. Vertical anodes are radially disposed in the tank and vertical cathodes enclosed in diaphragm bags are interposed between the anodes. Agitating means are located in the tank below the anodes and cathodes. Metal is removed from a central collecting container in the tank by pump means.

30 Claims, 7 Drawing Figures

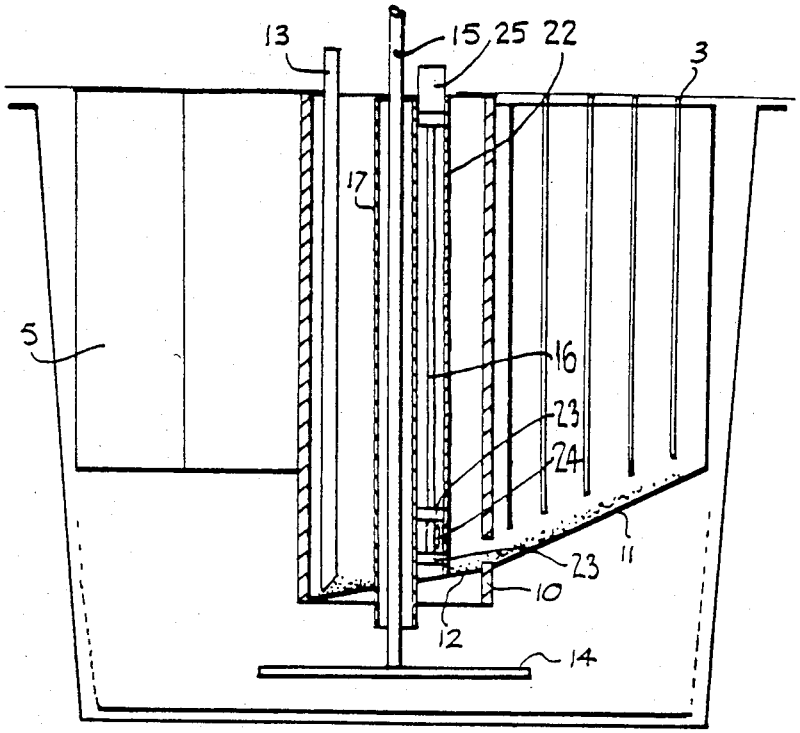
FIG. 3.
FIG. 6.
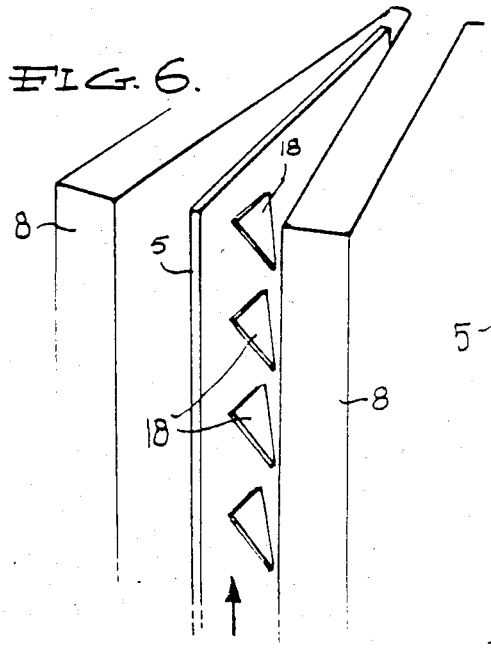
FIG. 7.
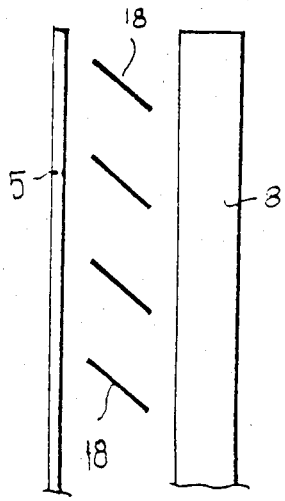

ELECTROLYTIC CELL FOR RECOVERY OF METALS FROM METAL BEARING MATERIALS

FIELD OF THE INVENTION

This invention relates to an electrolytic cell for treating mineral ores and concentrates.

BACKGROUND OF THE INVENTION

The electrolytic cell is of particular importance in recovery of copper from copper bearing ores and concentrates as described in U.S. Pat. No. 4,061,552 and the recovery of lead from lead bearing ores and concentrates as described in U.S. Pat. Nos. 4,148,698 and 4,381,225.

In these processes not only are electrodes and electrolyte involved but also two lots of solids, the metal bearing ore or concentrate and the particulate metal product. To achieve a maximizing of reaction with resultant high yield it has been previously believed the anode and cathode should be in close parallel relationship. Illustrative of this general belief can be seen in Australian Pat. No. 292,235 where considerable emphasis is given to a design which preserves a parallel relationship.

Also typical of the conventional electrolytic cell is the use of diaphragm bags surrounding the cathode. A multiplicity of diaphragm bags is employed to keep slurry away from the cathodes where clean metal is required to be deposited. Some problems experienced in the operation of such a cell include:

(1) Clogging of the diaphragm materials with particles when high hydraulic gradients must be used in the cell to maintain a uniformity of agitation of the slurry.

(2) Difficulties in trying to maintain large areas of cloth in parallel planes without distortion, which is particularly aggravated by high hydraulic gradients in the cell. In most cases it is undesirable for the cloth to come in contact with (3) The energy requirements resulting from the necessity for agitation in the bottom of the cell to maintain adequate suspension of the mineral between the bags.

Other problems include:

Difficulties in recovering the metal powder if it falls off the electrodes into the cell floor or the bags, or difficulties and costs in removing and stripping the electrodes if the metal particulate adheres strongly.

To overcome these problems it has been known to introduce additives into the electrolyte which inhibit the growth of dendrites of metal powder on the cathode. Further, many attempts have been made to provide a simple and effective recovery of metal powder. However the very design of parallel cathode relationship complicates recovery. In particular, previously it has not been possible to integrate a central recovery system, especially with diaphragm cells, without complex pipework and flushing techniques.

The present invention includes apparatus which overcomes these problems and in addition provide cells which are relatively inexpensive, long lasting and allow greatly increased efficiency of operation. Also provided is apparatus for the removal of products such as the metal powder products according to U.S. Pat. No. 4,061,552 for copper and U.S. Pat. Nos. 4,148,698 and 4,381,225 for lead.

The methods the subjects of U.S. Pat. No. 4,061,552 and U.S. Pat. Nos. 4,148,698 and 4,381,225 and the apparatus of this patent application provide a unique combination of a slurry of minerals of metals including copper, lead, silver, zinc, bismuth, gold, nickel and cobalt in electrolyte, and extraction of one or more of the valuable metals from the electrolyte by electrolytic means. The system operates at atmospheric pressure, at temperatures below the boiling point of the electrolyte, and with no exotic or costly reagents or materials and no close tolerances.

SUMMARY OF INVENTION

Surprisingly after considerable research and development, it has been found that radially disposed anodes and cathodes give comparable reaction efficiencies to the common parallel electrode practice. Further the use of radial disposition facilitates efficient and economical central recovery of particulate metal.

Accordingly, in one aspect of the invention there is provided an electrolytic cell for recovery of metal from mineral ores or concentrates comprising:

(a) a tank adapted to hold a slurry of electrolyte and said mineral ores or concentrates;

(b) mechanical and/or pressurized gas means within the tank for agitating said slurry;

(c) a plurality of vertical anodes radially disposed in said tank; and (d) a plurality of vertical cathodes radially disposed in said tank and interposed between said anodes.

Preferably there are also included means for removal of metal from the cathodes within the cell, and also means for heating said slurry or electrolyte when process conditions require the cell to operate at higher than atmospheric temperature.

Preferably turbulent means are also included to promote turbulent flow. In the case of a copper containing slurry it is desirable to have the slurry in a turbulent state in the vicinity of the anode surface. In the case of a lead containing slurry it is desirable to have the solid free solution in a turbulent state around the anode surface. This is believed to minimize a polarizing effect which is ordinarily induced at the anode surface. In the prior art high hydraulic gradients are employed. In contrast to this the turbulent means may be vanes interposed between the anode and cathode. These therefore cause the slurry or solids free solution to constantly impinge on the anode surface. The vanes could be independently positioned or form part of the outer surface of a diaphragm bag if present. Similarly the turbulent flow means may be protuberances on the actual anode surface. The irregular anode surface in this arrangement would inhibit a surface laminar flow of slurry and permit fresh slurry to be reacted.

In another preferred embodiment of the invention porous diaphragm bag means surround each of the cathodes to separate the slurry from the metal. It is well known if the diaphragm bag collapses onto the cathode there will be a loss in efficiency of the chemical reaction. Accordingly it is desirable to attach the bag means to a plurality of vertical frame members located inside the bag means which prevent substantial collapse.

Further in another aspect of the invention the particulate metal falls from the cathode and lies in the bottom of the diaphragm bag means. To facilitate removal of the product it is desirable to have the bottom of the bag means declining towards a central collection means, located centrally of all the bag means. The radial disposition of the diaphragm bag means therefore permits an arrangement which results in all bag means emptying product in the central collection means. To assist further concentration of product in the collection means it may be provided with a biased surface. This surface causes the product to accumulate in one point where the means for removal of metal can be located.

With regard to the anode, as previously indicated it was surprisingly found that a parallel relationship with the cathode was not strictly required. The radial arrangement of anodes display an acceptable chemical efficiency whilst allowing superior product recovery techniques. Nevertheless the parallel relationship aforementioned can be if desired, more closely approximated by the use of wedge shaped anodes. The wedge shape will, of course, be in the transverse cross-section. Similarly if plate anodes are not required the anode may be constituted by a plurality of vertical rod anodes.

With regard to the cathode, this may be of any convenient shape and is typically constituted by a plurality of vertical rods or pipes. Particulate metal powders are produced on these cathodes at high current densities resulting in a slightly higher cathode potential than in the production of an adherant plate. This over potential helps to distribute the current uniformly on the plate anodes because of the very low IR drop in the electrolyte compared with this over potential. Care should be taken to ensure there is no excessive dendritic growth of particulate metal which would inhibit recovery efficiency. Typically this may be controlled by periodic vibration of the cathode and/or adopting a cathode shape which inhibits excessive growth before falling to the bottom of the diaphragm tag.

Accordingly, in another preferred aspect of the invention at least one of the plurality of cathodes comprises:

(a) a conductive portion; and (b) a non-conductive covering overlaying a portion of the conductive portion. The non-conductive covering may be perforated shrink plastic tubing or plastic net applied to the conductive portion by heat shrinking. This entails covering the cathode with the shrink plastic tubing or net, heating same, which shrinks onto the cathode. The product then grows out from the cathode and falls off in discreet forms of the maximum size desired for ease of pumping out the product as slurry.

The gas means may be added directly and/or by one or more gas dispersers. Further pressurized gas may contain oxygen e.g. air which may be needed for conversion of the mineral ores or concentrates to metal.

Alternatively the pressurized gas may contain added water vapour e.g. steam, so that the water vapour in the gas is close to equilibrium with the electrolyte at the point or points of the gas.

The pressurized gas may be admitted to the slurry by means of a porous gas disperser. The gas may be admitted through an open pipe underneath an agitator, for example, a radial flow turbine.

Having discussed the various preferred aspects of the invention reference is now made to some general constructional features thereof:

1. The tanks may be made of ordinary resin and fibreglass, with circular cross-section to avoid stress at corners. The tanks may be slightly tapered for stacking during storage and transport.

2. The diaphragm cloth can be made of commercial polypropylene, preferably with both felted and woven layers to prevent stretch and distortion of the mesh size.

3. Simple frames of metal, fibreglass, plastic or other material are made to support the diaphragm bags, with lightness and strength. There are no horizontal components above the bottom sections which will obstruct free settling of metal product to the bottom, or free circulation of slurries.

4. Anodes may be made of graphite, and because of the low current densities, show almost no wear. The surface of the anodes may be grooved or shaped to add to surface area and to provide inclined surfaces that increase contact between mineral particles and electrodes but do not impede settling or circulation.

5. Cathodes are typically of copper. The metals plated either fall or are shaken off the cathodes to collect in the bottom of the bags. If necessary, the cathodes may be shaken periodically to assist in detaching the metal deposits.

6. The metals are deposited at current densities high enough so that instead of forming as plates or layers on the surface of the electrode they grow as crystallites that are easily detached.

7. In cases where the metal deposited on the electrode surface coalesces and falls off in large fragments, this may be prevented by breaking up the surface of the electrode with a non-conducting lattice. One convenient method of achieving this effect, as indicated previously, is by covering rod or pipe electrodes with perforated shrink plastic tubing or plastic network.

8. For those minerals or metals requiring an oxygen-containing gas as a reagent, slurry contact with the electrode is usually necessary. In these cases, the oxygen-containing gas, generally but not necessarily air, performs the following functions very economically:

(a) The fine gas bubbles mix evenly and intimately with the slurry to enable the unique reaction of gas, slurry and oxygen at the electrode surface. Very high efficiency of oxygen consumption from air has been achieved (e.g. 50%), (b) the gas provides uniform and effective slurry suspension and uniform turbulence in the slurry, increasing energy efficiency and preventing strong or uneven turbulence which may distort the diaphragm bags, (c) the gas bubbles moving parallel to the sides of the diaphragm bags flush the surface and help prevent plugging of the bags by slurry, (d) the gas bubbles in the slurry compartment help equalise the specific gravity of the slurry and that of the electrolyte without slurry on the other side of the diaphragm. Unwanted pressures across the bags can thus be avoided.

9. The gas introduced below the cathode bags by one or more pipes independent of or in the middle of the agitator shaft. These pipes may be porous tubes coated with porous fabric. The gas bubbles provide a uniform turbulence between the bags and about the anodes.

10. For these minerals and metals where an oxygen-containing gas is not required, the slurry may not need to contact the anodes. In these cases the cell may be built deeper and the slurry of ore or concentrate stirred in the compartment below the bags to achieve complete mixing and contact with the electrolyte. Turbulence of the anolyte is arranged to carry dissolved material past the anodes at a sufficient rate. Another gas such as nitrogen may be used to provide uniform agitation of the slurry or electrolyte.

BRIEF DESCRIPTION OF THE DRAWINGS

Reference is now made to the drawings which illustrate various preferred aspects of the invention.

FIG. 3 is a partial longitudinal cross-section view of the cell.

FIG. 6 is a perspective view of turbulence means in the cell.

FIG. 7 is a side view of the turbulence means of FIG. 6.

In FIG. 1 a top view of the cell 1 is depicted. The cell 1 is provided with cover 2 through which cathodes 3 extend. Cathodes 3 extend longitudinally into the cell 1 and are radially positioned therein. Above cover 2 the cathodes 3 are provided with an upstanding connection member 4 which over the entire cover constitutes a fragmented circle. A circular busbar 4*a* only a section of which is shown is affixed to members 4 thus permitting energizing of the cathodes 3. Interposed radially between cathodes 3 are anodes 5 (shown in FIG. 3) which traverse the cover 2 and affixed in holders 6. These can be affixed using any conventional means e.g. bolts or pins. Holders 6 also being radial positioned are in contact with circular busbar 7 thus allowing easy energizing of each anode.

Figure 5:
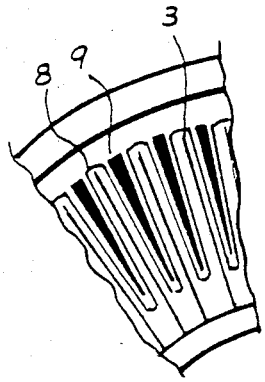
FIG. 5 is a fragmented transverse cross-section view of an alternate form of anode.
Figure 2:
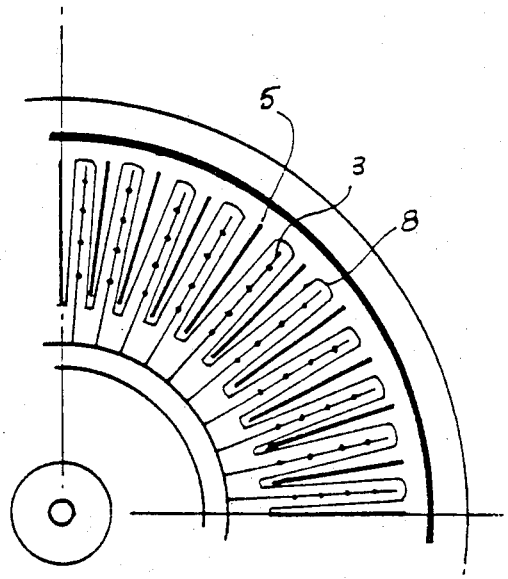
FIG. 2 is a partial transverse cross-section view of the cell.

Reference to FIG. 2 shows the typical arrangement of anodes 5 and cathodes 3 in the cell 1. Cathode 3 may be any convenient shape. As shown it comprises a plurality of rods encased in a diaphragm bag 8. These bags 8 are used to separate the slurry to be treated from liberated migrating metal ions. Whilst anodes 5 and cathodes 3 are not exactly parallel, the chemical efficiency of the system has not suffered. If however it is desired to achieve a more parallel arrangement, wedge shaped anodes should be used. Reference to FIG. 5 reveals the arrangement utilizing wedge shaped anodes 9. The surfaces of anodes 9 are substantially parallel to cathodes 3.

FIG. 3 more particularly shows the recovery system of cell 1. As previously indicated the adoption of a radial array of cathodes 3 in diaphragm bags 8 allows each bag to communicate with a central collecting container 10. By designing diaphragm bags 8 with a bottom 11 sloping toward container 10, the particulate metal which falls to the bottom 11, will move into container 10 by gravity or vibration. The system may be vibrated through shaft 16 driven by motor 25. Shaft 16 is enclosed in tube 22 attached to central tube 17 and is journalled in spaced-apart bearings 23. Eccentric member 24 attached to shaft 16 between the bearings 23 imparts an out of balance rotation to shaft 16 to provide the necessary vibration in the system. Within container 10 a biasing surface 12 is provided which directs all incoming particulate metal towards a product recovery tube 13. The particulate metal product is pumped out as a slurry with electrolyte and is passed for separation. Separation may be by settling or other conventional method whereafter electrolyte is recirculated into cell 1.

Positioned centrally of cell 1 is a central agitator comprising impeller 14 connected by axial shaft 15 to a driving motor (not shown). This agitator distributes mineral and electrolyte, causing the slurry to flow past and if necessary contact anodes 5. Gas may be introduced beneath the impeller 14 when oxidation is required. Preferably, a constant turbulent movement of the slurry against the anode surface is required. The central agitator whilst imparting an upward movement on the slurry cannot without considerable extra energy approximate the desired movement between the diaphragm bag 8 and anode 5. Accordingly as shown in FIGS. 6 and 7, turbulent means 18 are provided to deflect the upcoming slurry towards the anode surface. Whilst shown as independent deflectors, it will be readily apparent the desired turbulent flow could be achieved by deflectors on the diaphragm bag 8 or providing the anode 8 with an irregular surface e.g. protuberances. Same would achieve the object of substantially disrupting the laminar layer adjacent the anode surface which can cause polarization.

Figure 1:
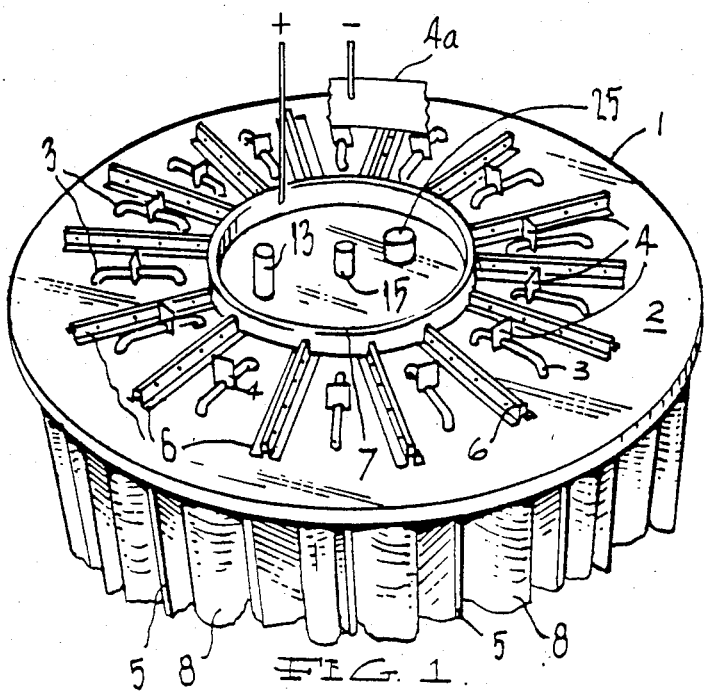
FIG. 1 is a perspective view of the top of a diaphragm cell.
Figure 4:
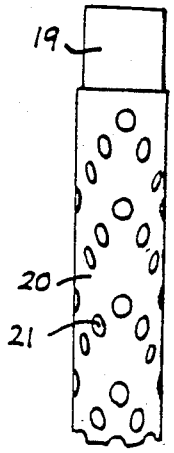
FIG. 4 is a view of an electrode coated in accordance with a further aspect of the invention.

FIG. 4 shows the surface of electrodes for the deposition of product in an easily detachable form. A conductive electrode 19 is partially covered with a nonconductive material 20 which allows product to grow from the electrodes 19 only in certain areas 21. One of the most convenient methods of achieving this effect is by covering rod or pipe electrodes with perforated shrink plastic tubing or plastic net. The plastic tubing or net is then heated and shrinks onto the rcd or tube. This causes the product to grow out from the electrode in small discreet forms which allows it to be easily detached from the electrode (in some cases assisted by a periodic vibration of the electrode) and easily pumped as a slurry.

The foregoing describes the mechanical advantages of the cell design. The following data shows a chemical effect of such cell design.

EXAMPLE 40 kilos of a copper concentrate analysing 23% copper and 23.2% iron were added to a cell, as described in the drawings, which contained 1500 l of electrolyte analysing 35 gpl copper (total ionic Cu) 6.4 gpl of cupric and 0.5 gpl of iron. The mixture was aerated using 135 l of air per minute and current was passed at a rate of 700 amps with a voltage of 1.0 V. The cathodes were gently tapped every 15 to 30 minutes and a small vibration imparted to the fibreglass frame to allow the copper powder to travel down the arms into the sloping bottom of the central container. From the lowest point of this container the copper powder was withdrawn, in slurry form, through a vertical pipe, as required, to a settling chamber where the copper powder separated from the electrolyte which then passed to a centrifugal pump for transfer back to the cell. The pH of the mixture in the anolyte compartment remained between 2.2 and 3.0 throughout the test and could be varied slightly by adjusting the amount of air admitted to the cell. A decrease in the amount of air admitted to the cell could lower the pH to the 2.0 to 2.5 pH preferred range. After 10 hours operation the air and current were turned off and the slurry was filtered and the filter cake washed and dried. The filter cake analysed 0.8% copper and 24% iron giving a recovery of 97% of the copper from the mineral with an electrolysis power consumption of approximately 0.75 KWH per kilo of copper produced. The sulphur in the chalcopyrite concentrate was almost completely converted to elemental form and the iron was converted to an oxide and remained substantially in the residue. This example illustrates the single step conversion of copper concentrates to high purity metal and elemental sulphur avoiding atmospheric pollution from sulphur dioxide and using very low energy at atmospheric pressure and moderate temperatures.

I claim:

1. An electrolytic cell for recovery of metal from mineral ores or concentrates comprising:
(a) a tank adapted to hold a slurry of electrolyte and said mineral ores or concentrates,
(b) means within the tank for agitating said slurry,
(c) a plurality of vertical anodes radially disposed in said tank,
(d) a plurality of vertical cathodes radially disposed in said tank and interposed between said anodes,
(e) porous diaphragm bag means which surround said radially disposed plurality of cathodes and separates said cathodes from the electrolyte slurry.

2. An electrolytic cell according to claim 1 further comprising means for heating said slurry or electrolyte when process conditions require the cell to operate at higher than atmospheric temperature.

3. An electrolytic cell according to claim 1 further comprising means for removal of metal from said cathodes within the cell.

4. An electrolytic cell according to claim 1 further comprising turbulent means to promote turbulent flow of said slurry at the surface of at least one of said anodes.

5. An electrolytic cell according to claim 4 wherein said turbulent means comprises a plurality of vanes interposed between said anodes and cathodes.

6. An electrolytic cell according to claim 4 wherein said turbulent means comprises a plurality of protuberances on said surface.

7. An electrolytic cell according to claim 1 wherein said porous diaphragm bag means has a bottom declining towards a central collection means.

8. An electrolytic cell according to claim 7 wherein said central collection means comprises a receptacle having a biased surface to promote movement of metal emanating from said porous diaphragm bag means towards said means for removal of metal.

9. An electrolytic cell according to claim 1 wherein said porous diaphragm bag means is attached to a plurality of vertical frame members located inside said bag means to restrict movement thereof and minimize metal build-up other than in a lower portion of said bag means.

10. An electrolytic cell according to claim 1 wherein at least one of said anodes has a wedge shaped transverse cross-section.

11. An electrolytic cell according to claim 1 wherein at least one of said anodes is a plate anode.

12. An electrolytic cell according to claim 1 wherein at least one of said anodes comprises a plurality of vertical rod anodes.

13. An electrolytic cell according to claim 1 wherein at least one of said cathodes comprises a plurality of vertical rod cathodes.

14. An electrolytic cell according to claim 1 wherein said agitating means comprises pressurized gas added to said slurry.

15. An electrolytic cell according to claim 14 wherein said pressurized gas contains oxygen which is required for the anode and/or chemical reactions occurring within the cell.

16. An electrolytic cell according to claim 14 wherein the pressurized gas contains added water vapour, so that the water vapour in the gas is close to equilibrium with the electrolyte at the point or points of admission of the gas.

17. An electrolytic cell according to claim 14 wherein said pressurized gas is admitted to the slurry by means of a porous gas disperser.

18. An electrolytic cell according to claim 14 wherein said pressurized gas is added directly to said slurry.

19. An electrolytic cell according to claim 14 wherein said pressurized gas is added by at least one gas dispenser to said slurry.

20. An electrolytic cell according to claim wherein siad agitating means includes a radial flow turbine.

21. An electrolytic cell according to claim 1 wherein at least one of said plurality of cathodes comprises:
(a) a conductive portion; and
(b) a non-conductive covering overlaying a portion of said conductive portion.

22. An electrolytic cell according to claim 21 wherein said non-conductive covering is perforated shrunk plastic tubing or plastic net applied to said conductive portion by heat shrinking.

23. An electrolytic cell according to claim 1, including means for applying a positive potential connected to said anode and means for applying a negative potential connected to said cathode.

24. An electrolytic cell according to claim 1, wherein said porous diaphragm bag means includes a bag surrounding each of said cathodes, said bags being a continuous membrane and including means for separating said slurry form liberated metal ions migrating to said cathode.

25. An electrolytic cell for recovery of metal from mineral ores or concentrates, comprising:
(a) a tank adapted to hold a slurry of electrolyte and said mineral ores or concentrates,
(b) means within the tank for agitating said slurry,
(c) a plurality of vertical anodes radially disposed in said tank, and
(d) a plurality of vertical cathodes radially disposed in said tank and interposed between said anodes, at least of one of said plurality of cathodes comprising:
(i) a conductive portion; and
(ii) a non-conductive covering overlaying a portion of said conductive portion, wherein said non-conductive covering is perforated, shrunk plastic tubing or plastic net applied to said conductive portion by heat shrinking.

26. An electrolytic cell according to claim 25 wherein at least one of said cathodes comprises a plurality of vertical rod cathodes.

27. A cathode for use in an electrolytic cell for recovery of metal from mineral ores or concentrates, comprising:
a conductive portion; and
a non-conductive covering overlaying la portion of said conductive portion, said non-conductive covering comprising a perforated tubular member formed of heat shrinkable plastic material which is heat shrunk directly around said cathode to leave only areas of said cathode exposed which are positioned under perforations of said non-conductive covering.

28. A cathode according to claim 27 wherein said conductive portion is rod shaped.

29. A cathode according to claim 27 wherein said conductive portion is a tube.

30. A method of producing a cathode for use in an electrolytic cell for the recovery of metal from minerals ores or concentrates, comprising:

providing an elongated conductive member;

contacting and said elongated conductive member with a perforated tubular non-conductive covering formed of heat shrinkable plastic; and heat shrinking said non-conductive covering so as to leave exposed only areas of said conductive member which lie below perforations of said non-conductive covering.

* * * * *